United States Patent [19]

Halme

[11] Patent Number: 4,781,793

[45] Date of Patent: Nov. 1, 1988

[54] METHOD FOR IMPROVING PAPER PROPERTIES IN MULTIPLY PAPER USING LONG AND SHORT FIBER LAYERS

[75] Inventor: Matti Halme, Helsinki, Finland

[73] Assignee: Valmet Oy, Finland

[21] Appl. No.: 69,859

[22] Filed: Jul. 6, 1987

[30] Foreign Application Priority Data

Jul. 4, 1986 [FI] Finland ..... 862847

[51] Int. Cl.[4] ..... D21F 11/04; D21H 5/12

[52] U.S. Cl. ..... 162/55; 162/129; 162/130

[58] Field of Search ..... 162/129, 130, 55, 4, 162/300, 301

[56] References Cited

U.S. PATENT DOCUMENTS

| | | | |
|---|---|---|---|
| 1,880,692 | 10/1932 | Berry | 162/130 |
| 3,791,917 | 2/1974 | Bolton, III | 162/130 |
| 3,823,063 | 7/1974 | Ward et al. | 162/129 |
| 3,839,143 | 10/1974 | Suckow | 162/123 |
| 3,884,750 | 5/1975 | Iannazzi | 162/4 |
| 3,925,150 | 12/1975 | Marsh | 162/4 |
| 4,332,638 | 6/1982 | Mauer et al. | 162/55 |
| 4,334,984 | 6/1982 | Vagac et al. | 162/4 |
| 4,405,450 | 9/1983 | Selder | 162/4 |
| 4,562,969 | 1/1986 | Lindahl | 162/55 |
| 4,614,566 | 9/1986 | Koponen et al. | 162/301 |

FOREIGN PATENT DOCUMENTS

| | | | |
|---|---|---|---|
| 583483 | 4/1959 | Canada | 162/130 |
| 2501365 | 2/1975 | Fed. Rep. of Germany | 162/129 |
| 46642 | 1/1973 | Finland . | |
| 842050 | 11/1985 | Finland . | |
| 851650 | 10/1986 | Finland . | |
| 8500042 | 12/1985 | PCT Int'l Appl. . | |

*Primary Examiner*—Peter Chin
*Assistant Examiner*—K. M. Hastings
*Attorney, Agent, or Firm*—Steinberg & Raskin

[57] ABSTRACT

Method in a paper manufacturing process for improving the properties of the paper, in particular its retention. In the method, the fibre material is passed through a refining and screening system to the head-box arrangement of a paper machine, which comprises one or several head boxes, through which the stock suspension is fed onto a forming wire or into a forming gap (G) between a pair of forming wires (40,41). Two different components are formed out of basic stock which contains substantially all the fibres to be used for the paper to be manufactured. Of these components, one component contains mainly fibres longer than the average distribution of fibre length in the basic stock, while the other stock component contains mainly fibres shorter than average and fines as well, in addition to a possible additive component or components for the stock, if any. The stock component of longer fibres is fed, by means of a multi-channel head box, into direct contact with the forming wire or wires (40,41). The stock component which contains shorter fibres and possibly also filler material, is fed by means of the head-box arrangement either, in the case of a twin-wire former, into the middle of the layer structure formed by the stock components with longer fibres, or, in the case of a single wire, such as a fourdrinier wire, onto the stock component with longer fibres which is in direct contact with the wire, to form a surface layer in the layer structure.

22 Claims, 1 Drawing Sheet

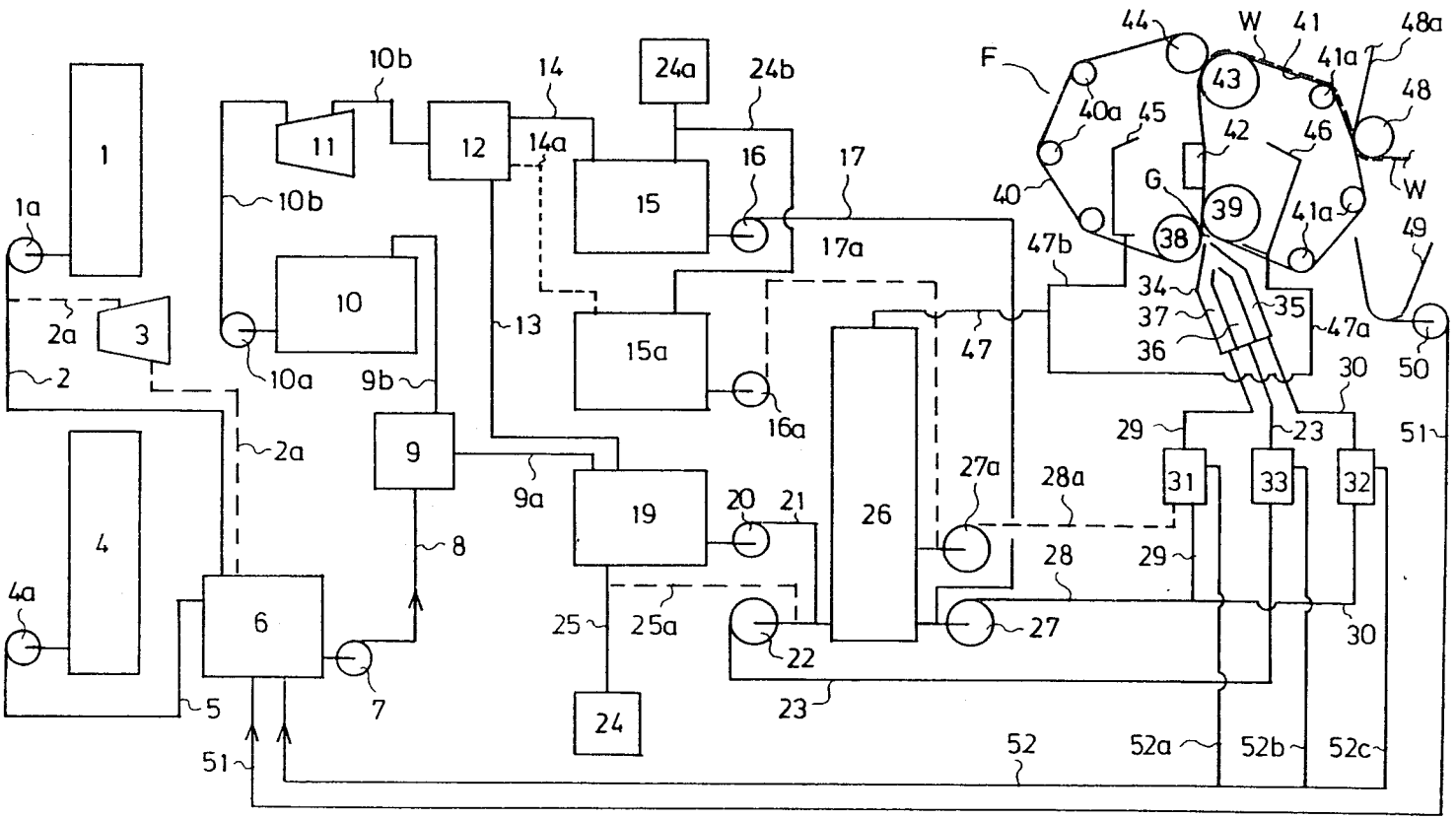
1
1a
2
2a
3
4
4a
5
6
7
8
9
9a
9b
10
10a
10b
11
12
13
14
14a
15
15a
16
16a
17
17a
19
20
21
22
23
24
24a
24b
25
25a
26
27
27a
28
28a
29
30
31
32
33
34
35
36
37
38
39
40
40a
41
41a
42
43
44
45
46
47
47a
47b
48
48a
49
50
51
52
52a
52b
52c
F
G
W

METHOD FOR IMPROVING PAPER PROPERTIES IN MULTIPLY PAPER USING LONG AND SHORT FIBER LAYERS

BACKGROUND OF THE INVENTION

The present invention concerns a method in a paper manufacturing process for improving the properties of paper, in particular the retention of, e.g., fines and fillers, in which the fibre material is passed through a refining and screening system to a head-box arrangement of a paper machine having at least one headbox, and through which the stock suspension is fed onto a forming wire or into a forming gap between forming wires.

The principal raw-material for paper comprises fibres derived from cell tissues of various plants. The most important fibres for the manufacture of paper are obtained from softwood or hardwood, however fibres obtained from, e.g., straw or bagasse can be utilized in certain cases. The fibres can be separated from the wood raw material by a chemical or mechanical defiberizing process. Such defiberizing processes are known in the art in and of themselves, so that detailed description thereof is not necessary for an understanding of the present invention. The fibre material obtained by the chemical method is generally called chemical pulp, while the fibre material produced mechanically is usually called groundwood pulp or mechanical pulp. There are also intermediate forms between these manufacturing proesses, with pulp types obtained by such means or intermediate forms.

In the paper manufacturing process, the fibres are first pre-treated in a suitable manner, principally mechanically in particular refiners. Thereupon, the fibres are suspended into a 100-fold to 200-fold quantity of water, to form a fibre-water suspension, which is then passed to the paper machine.

An important difference between the chemical and mechanical pulps, is that the mechanical pulps can be passed practically directly from the defiberizing stage to the paper machine, although fibres of chemical pulp must be processed in a certain manner and treated by refining before paper can be manufactured from the same. Moreover, due to the process of manufacture, the average fibre length of mechanical pulp, is, as a rule, shorter than that of chemical pulp. However, the average fibre length in a pulp depends primarily upon the raw-material of pulp itself.

By nature, the average length of softwood fibre is most usually about three-fold, as compared to hardwood fibre. It has also been ascertained that fibre obtained from different hardwood species, may differ from one another, e.g., with respect to the length thereof, and also with respect to other properties, differing even tremendously in this regard. Extreme examples in this respect are birch fibres on the one hand, and eucalyptus fibres on the other hand, both of which are commercially and industrially important raw materials for the paper industry.

The principal parts of a paper machine are the head box, the forming section, the press section, and the drying section. The paper is manufactured in a continuous process, so that the fibre suspension is fed through the head box as an even layer onto an endless wire fabric moving forwardly and included in the web former, where the suspension water drains principally through the meshes in the wire fabric while the fibres are intertwined and bound together to form an integrated wet fibre mat or web. Further removal of water out of the web formed in this manner described above takes place mechanically in the press section of the paper machine and in the drying section by means of heat evaporation, whereby a completely dry paper web is obtained as the final result.

The ultimate properties of the paper produced are determined, in addition to the particular type of raw-material used, by the manner in which the paper machine and the webforming process treat these particular raw-materials. The most important operative factors in the mechanism of forming the paper web, are the head box and the wire part whose cooperation is decisively important for the web formation.

The fibre material or stock from which the paper is manufactured, is by nature highly nonhomogeneous with respect to both the length and the thickness of the fibres. The longest fibres are of an order of 2 to 3 mm, while the shortest fibres are about 1/10 of this length. Moreover, the fibre stock contains varying quantities of so-called tines, i.e. indefinite fragments of fibre. As a matter of fact however, this non-homogeneity of the stock is necessary for the formation of even paper. With simplification, it can be said that the long fibres contained in the stock form the fibre network constituting the basic structure of the paper web, while the rest of the fibre material fills the meshes in this network.

Only few paper qualities are produced by using a single fibre type alone. Such qualities are, e.g., kraft papers, which are, as a rule, manufactured from softwood pulp only. In most cases, at least two kinds of fibre are used for paper, such as, e.g., for newsprint, whose fibre composition may comprise 75 to 85 percent mechanical pulp and correspondingly, 15 to 25 percent chemical pulp. The reason for the use of different types of fibres may be exclusively a matter of cost. As a rule, attempts are made to use as inexpensive fibres as possible, if the quality requirements imposed on the paper permit it.

Recently, the paper industry has encountered several serious problems. The cost of cellulosic pulp has increased. Authorities have imposed even stricter ecological requirements which have increased the cost of paper manufacture. Also, the general direction of evolving energy cost of paper manufacture, has been increasing. These circumstances have placed the paper industry and its customers in a situation of having to make a choice. Either the higher costs must be paid for, or the proportion of cellulose fibres must be reduced or fibres of inferior quality must be utilized, which, with the present paper manufacturing techniques, results in a deterioration of the quality of the paper products, in particular of the printing properties thereof.

However, in most cases the reason for the use of fibre mixtures, is that certain fibres give the paper desirable properties. Thus, some fibres give the paper increased strength, while other fibre types may improve other properties, e.g. brightness, smoothness, opacity, or porosity. There are numerous fibre combinations, and also combinations of properties which are desired in paper.

The exclusive role of fibre material in paper manufacture and as a factor affecting the properties of paper, has been dealt with above. However, several paper qualities, in particular those intended for printing, contain considerable amounts of mineral so-called fillers or pigments. Moreover, coloring agents, sizes or other chemicals may be added to paper stock in the amount of a few percent. The proportion of the latter additives in the stock is however, small as compared, e.g., with the fillers, whose proportion is most generally 10 to 40 percent of the weight of finished paper. By means of the fillers, a number of good properties are obtained in the paper, of which some of the most important ones are opacity, smoothness and glazability of the paper, as well as, moreover, elasticity of the paper which reduces, e.g., rustling of the paper.

In accordance with the above, the paper comprises several components, with the main groups thereof being the fibres proper, the tines, and the fillers. When the relative proportions of these components are appropriately chosen, the desired properties can be obtained in the finished paper. The web forming process on the wire part and the constructional factors of the wire part affecting the process may cause an amount of valuable components, above all fine fibres and fillers, to be lost from the stock along with water being removed, at the same time that the water is being removed out of the fibre suspension. The property of the inchoating web that is in this stage on the wire part, for retaining the fine fibres and filler particles present in the fibre suspension in the paper structure during the dewatering process, is termed the ability of retention. Besides the fibre material itself and its, e.g. physical-chemical properties, the retention is also affected by many external factors, such as mesh of the wire fabric, type of the forming members, running speed of the paper machine, etc. The web forming process must be arranged to take place and must be controlled so that in particular, the content of fines in the stock and in the finished paper is as high as possible, and that the distribution in the direction of thickness of the paper is assymmetric as possible. In particular, paper intended for printing must not show so-called two-sidedness, but both sides must be as equal as possible regarding smoothness and porosity, i.e. printing properties thereof.

Such web-forming processes, by means of which these objectives of quality of paper are achieved, can best be accomplished by means of so-called twin-wire formers, of which there are several different types.

One such twin-wire former is described in Finnish Patent Application No. 842050. It is an essential feature of the operation of this twin-wire former that at the initial stage of the web-forming, the dewatering arranged to take place very gently in two directions. In this manner, a pre-couched fibre layer is initially obtained on both wires, such layers acting as filters for the fines contained in the pulp suspension as the dewatering continues and is gradually intensified. In contrast thereto, in the most common twin-wire formers the dewatering takes place right from the start extremely violently, which is not advantageous for the paper forming process.

SUMMARY OF THE INVENTION

Accordingly, it is an object of the present invention to provide a stock preparation method to be applied before the paper machine, such a method being particularly well-suited for carrying into effect the principles of web formation described in Finnish Patent Application No. 842050, and which permits intensification of dewatering in wire parts of this type or equivalent without detrimental decrease of retention of the fines present in the pulp. The intensification of dewatering permits, e.g., an increased running speed of the paper machine. If principal attention is directed to improved retention, it is possible to lower the grammage of the paper to some extent without deterioration of the opacity of the paper, and, at the same time, to obtain corresponding economies of raw-material.

Other objects of the present invention will become apparent from the following description thereof.

These and other objects are attained by the present invention which is directed to a method for use and manufacturing paper, which involves separating a basic stock suspension into a first stock suspension component and a second stock suspension component. The first component principally contains fibres which are longer than an average length of fibres in the basic stock suspension, while the second component principally contains fibres which are shorter than the average fibre length. The first stock suspension component is fed directly onto to a forming wire to form a first layer thereon, while the second stock suspension component is fed directly onto the first layer to form a second layer thereon. Additionally, the first stock suspension component may be fed onto a second wire to form a third layer thereon, with the second stock suspension component being fed to form the second layer between the respective first and third layers.

In other words, the method of the present invention involves forming two different stock components from the basic stock containing substantially all fibres to be used for manufacturing the paper, with a first of the components principally containing fibres longer than average fibre length distribution in the basic stock, and the second of the components principally containing fibre shorter than the average fibre length distribution in the basic stock, in addition to fines. The first component is fed through a multi-channel head box into direct contact with a forming wire or with a pair of wires, while the second component is fed through the multi-channel head box onto the first component contacting the forming wire to form a surface layer thereon, or into the middle of the layer structure formed by the first component in contact with the pair of wires.

In view of achieving the objectives stated above in addition to those which will become apparent below, the present invention is principally characterized by a stock preparation system in which two different components are formed out of the basic pulp which contains substantially all the fibres to be used for the paper to be manufactured. One component contains mainly fibres longer than the average of the fibre length distribution in the basic pulp, while the other pulp component contains mainly fibres, shorter than average and fines, as well as a possible additive component or components for the pulp, if any. The pulp component of longer fibres is fed, by means of a multi-channel headbox, into direct contact with a forming wire or wires (40,41), while the pulp component with the shorter fibres, and possibly also containing filler material, is fed by means of this head-box arrangement either, in the case of a twin-wire former, into the middle of the layer structure formed by the pulp components with the longer fibres, or in the case of a single wire, such as a fourdrinier wire, onto the pulp component with the longer fibres, which is in direct contact with the wire, to form a surface layer thereon.

BRIEF DESCRIPTION OF THE DRAWINGS

With respect to details in the operation of the method in accordance with the present invention, reference is made to the accompanying figure, which is a schematic illustration of a flow diagram of a stock preparation system making use of the present invention, and a twin-wire former related to the same.

DESCRIPTION OF THE PREFERRED EMBODIMENTS

The pulp chests, refiners, screens and pumps etc. included in the system are symbolically shown in the figure as quadrangles and circles. The full lines or dashed lines connecting the same represent the pulp and water pipes in the system. In the diagram, the wire part of the paper machine which makes use of the system of the present invention is denoted, as a whole, by reference letter F, and it is illustrated as being of the so-called twin-wire type. The principle of the present invention is, however, also applicable to the stock preparation systems of conventional fourdrinier wire parts or so-called hybrid formers.

The stock intended to be passed to the wire part F of the paper machine comprises, e.g., chemical pulp of principally long fibres coming from the storage tank 1 of a pulp mill, and short fibered mechanical pulp coming from a corresponding storage tank 4 of a groundwood mill. The chemical pulp is passed through the pump 1*a* and the pipe 2, and the mechanical pulp is passed through the pump 4*a* and the pipe 5 into a mixing chest 6, in which the two pulps are mixed by means of chest mixers known per se (not illustrated) into an homogeneous paper stock. As used herein, homogeneity means principally uniformity of the proportions of components in the pulp mixture. The consistencies of the pulps may be, at this stage, of an order of about 3 to 5%.

The broke pulp produced in the paper machine, e.g., in connection with breaks as well as the so-called reject, which will be described below, is also passed into the mixing chest 6 through the pipes 51 and 52. In principle, the system of the present invention does not, in itself, require a certain consistency of the stock.

If necessary, a suitable refining treatment may be applied to the chemical pulp coming from the tank 1 of the pulp mill before the pulp is passed into the chest 6. In this alternative case, the pulp runs through the pipe 2*a* denoted in the diagram with a dashed line, passing into one or several stock refiners 3 and thereupon into the chest 6.

From the mixing chest 6, the pulp is pumped by the pump 7 through the pipe 8 into a pulp fractionating device 9, whose construction and operation may be similar to a pressure screen frequently used in the feed pipe system of the head box of a paper machine, for example in accordance with Finnish Pat. No. 46,642. A difference in principle between the fractionating device and the pressure screen, is that the pressure screen principally separates only impurities from the stock to be treated, while the fibre composition of the stock remains unchanged, the impurities forming a so-called reject of a quite small amount, 2 to 5%. In the fractionating device, the short fibres of the stock substantially, as a whole, form the "reject" whose amount depends on the perforation in the screen plates used in the device and may be, e.g., up to about 60 to 70%.

In the fractionating device 9, the stock is divided into two fractions, one of which contains mainly fibres having a length longer than average, while the other fraction correspondingly mainly contains fibres having a length shorter than average. In this connection, average fibre length means the average fibre length of the pulp contained in the chest 6. The short-fibre fraction obtained in this manner, most of which comprises mechanical pulp but which also includes a considerable amount of short fibres of a chemical pulp, is passed from the fractionating device 9 via the pipe 9*a* directly into the stock chest 19, which is provided with suitable chest mixers (not illustrated), the chest 6 also being provided with suitable chest mixers.

The long-fibre fraction which mainly comprises chemical pulp as well as long fibres of the mechanical pulp, is passed through the pipe 9*b* into an intermediate chest 10, and then through the pump 10*a* and the pipe 10*b* into one or several refiners 11 for the fibrillation of the fibres. The longer fibre material is thus treated, preferably by refining, so that it is fibrillated and becomes suitable to form a web surface layer that filters the fillers and short-fibre fraction.

Hereafter, the pulp is passed into a second fractionating device 12, whose construction is, in principle, similar to the construction of the first fractionating device 9. The second fractionating device 12 separates the short fibres produced during the refining process from the long-fibre fraction, with these short fibres being passed through the pipe 13 into the same chest 19 into which the short-fibre fraction obtained from the first fractionating device 19 has been already passed. The refined and fibrillated long-fibre fraction separated by the fractionating device 12, is passed through the pipe 14 into the stock chest 15.

There may also be a second chest 15*a* intended for such a long-fibre fraction, into which the stock is passed through the dashed pipe 14*a*. The chests 15 and 15*a* may operate simultaneously side by side, or they may operate so that one of the chests is a reserve chest. If the chest 15 and 15*a* operate side by side, additives required by the operation of the wire part, e.g. for improving the retention or affecting the color of the web, can be passed into one of the chests or even into both the chests, from the chest 24*a* through the pipe 24*b*.

The short-fibre fraction is pumped by the pump 20 from the pulp tank 19 through the pipe 21 to the intake side of the pump 22, where the stock (consistency about 2 to 5%) is diluted with circulating water, obtained from the tank 26 and coming from the wire part F, to a consistency of about 0.3 to 0.7% as required by the operation of the head box 34 and of the wire part F. The method requires the use of a so-called multi-channel head box, in itself known, which may be, e.g., similar to the head box described in U.S. Pat. No. 3,839,143. The stock diluted in this manner is passed by the pump 22 through the pipe 23 into the middle channel 36 in the head box 34 of the paper machine.

The pipe line is provided with a so-called pressure screen 33, in itself known, e.g. in accordance with the Finnish Pat. No. 46,642, in order to separate any undesirable materials that may be present in the stock, as reject, and to prevent their access to the paper machine. The reject is returned through the pipe 52*b* and 52 into the chest 6, or it is preferably passed out of the system completely.

The long-fibre fraction is passed from the stock chest 15 and/or 15*a*, in a manner corresponding to the treatment of the short-fibre fraction described above, through the pump 16 and/or 16*a* and the pipe 17 or 17*a* to the intake side of the mixing pump 27 and/or 27*a*, where, in the same manner as described with respect to short-fibre fraction, the stock is diluted to the consistency required by the operation of the head box and of the wire part. The stock is pumped through the pipe 28 and/or 28*a* along pipes 29 and 30 as illustrated into the lateral channels 35 and 37 in the head box 34, the channels being intended for the formation of the surface layers of the paper to be manufactured.

In the figure, a three-channel head box 34 is used as illustrated, with the lateral channels 35 and 37 intended for the long-fibre fraction and the middle channel 36 for the short-fibre fraction, as noted above. The supply of stock into the lateral ducts 35 and 37 may take place jointly, either by means of one pump 27 and along pipes 29 and 30, or so that the pump 27 supplies, e.g., the channel 35 along pump 30, and the pump 27*a* supplies the channel 37 along pipes 28*a* and 29.

Several different alternatives for the supply of stock into the channels 35, 36 and 37 into the head box 34 are possible within the scope of the present invention, which is clear to a person skilled in the art.

A filler or fillers that are possibly used in the manufacture of paper, e.g. kaolin, as well as possible agents for improving the retention, are passed from the tank 24 through the pipe 25 into the chest 19 for the short-fibre fraction. Alternatively, the filler may be passed through the pipe 25*a* directly to the intake side of the mixing pump 22. As noted above, the agents that improve the retention may also be added to the long-fibre fraction.

It is an essential feature of the stock preparation system in accordance with the method of the present invention, that the filler or fillers are fed with the short-fibre fraction into the middle or innermost 36 channel in the multi-channel head box 34, which contributes to the improvement in the retention of fillers. The principle objective of the method of the present invention is to increase the retention of fillers and/or fines in the web, in such a manner that both of the surface layers of the web, which are composed of well-fibrillated fibres, act as filter layers for the fine material.

The former making use of the method of the present invention, i.e. the wire part F, is preferably of the twin-wire type, which may be similar to those described in the Finnish patent application Nos. 842050 and 851650. As the principal parts, the wire part F includes a covering wire 40 and a carrying wire 41, both of them together with their necessary wire guide rolls 40*a* and 41*a*. Inside the covering wire loop 40, there is a breast roll 38, a stationary web forming member 42, and a leading roll 44 for the covering wire, as well as a water collecting trough 45. Inside the carrying wire loop 41, there is a first web forming roll 39, a second web forming roll 43, and a water collecting trough 46. The wire 41 is contacted by a pick-up roll 48, by means of which the web W formed is detached from the carrying wire 41 and passed, in a manner known in and of itself, on the face of a felt 48*a* from the wire part F of the paper machine to the press section (not illustrated).

The water drained out of the web W in the wire part F is passed from the troughs 45 and 46 via the collector pipes 47*b* and 47*a* and the pipe 47 into the circulating water tank 26.

The wire part F is provided with a chest 49 for wet broke, from which the wet broke produced, e.g., at the starting stage in the wire part F, is passed in a manner known in and of itself through the pump 50 and a related pipe 51 into the stock chest 6. The so-called reject coming from the screens 31, 32 and 33 belonging to the feed piping of the head box, is also passed through the pipes 52*a*, 52*b*, 52*c* and 52 into the pulp chest 6 or, if it includes unusable impurities, completely out of the system.

The pulp refining and screening system in accordance with the invention can also be applied to fourdrinier wire parts or to so-called hybrid formers, e.g. similar, to Finnish patent application No. 820742 and U.S. Pat. No. 4,014,566, in which case the head box belonging to the concerned wire part may have only two channels. In this case, the long-fibre fraction is fed onto the wire part so that it first forms a layer that filters the fines in the stock, similar to that described above, directly on the fourdrinier wire, with the short-fibre fraction being fed thereafter onto the filtering layer.

The method of the invention can also be applied to such fourdrinier wire parts in which two separate head boxes are used, one of which is a so-called secondary head box feeding the fines-containing stock onto the surface of an already partly formed web which contains the substantially long-fibre stock fed through the head box.

When the web is formed on a twin-wire former, the proportion of each surface layer in the thickness of the entire web W is advantageously about 10 to 15%, in which case the proportion of the surface fraction in the entire quantity of pulp is about 20 to 30%. These values apply mainly, e.g., to newsprint qualities having a grammage on the order of about 40 to 45 g/m$^2$. The method is, however, not confined to use in connection with the manufacture of any particular paper quality, but can be applied to all manufacture of paper. Correspondingly, the proportion of the surface layers in the case of thick paper qualities may be lower than with thin qualities.

The fibre mixtures of which the paper is manufactured are not necessarily just different combinations of mechanical and chemical pulps. Quite frequently, e.g., when high-quality writing or printing papers are manufactured, chemical pulp is exclusively chosen for raw-material. However, part of the pulp may be long-fibre softwood pulp, e.g. pine and/or spruce fibres, and part of the pulp may be short-fibre hardwood or groundwood pulp, which may be produced, e.g., of birch.

It should still be emphasized that the starting point in the application of the method of the present invention is a basic stock mixture which is ready-mixed, so that it contains different fibre components and which is normally intended to be fed as such from the chest 6 to the paper machine. Ordinarily, this stock mixture is subjected only either to refining and/or to a screening treatment that eliminates impurities or excessively long fibres. According to the invention, the basic stock mixture concerned is divided into two separate lines on the basis of the length of the fibres contained in the same, in each of which lines the fibres are treated in accordance with the objectives stated above. The stocks in these lines, each of them separately, are thereupon passed into the head box arrangement of the paper machine in the manner described above.

After the first fractionating, the long fibres may require a special refining treatment, e.g., in order to increase the fibrillation degree thereof. It may be necessary for the refined long-fibre fraction to be screened again, in order to separate excessively long and rigid fibres. This excessively long and relatively coarse fraction, whose amount is, however small, can possibly be mixed with the stock of the middle layer in certain cases in order to improve the strength of the web.

The dewatering in the web formation stage, in particular at the initial stage thereof, is performed gently, e.g. in the manner described in Finnish patent application No. 842050.

In the head box, the feed nozzle part for the middle layer extends, in certain cases, into the gap G between the wires 40 and 41, preferably deeper than the nozzles for the surface stock. In this manner, the intended precouching of the surface layers of the web W is ensured. The surface stock jets may be fed into the gap G preferably at a higher speed than the stock for the middle layer. However, as is well known, the speed of the jet and/or jets in relation to the speed of the wire part, has a substantial affect on the properties of the paper that is being manufactured. This speed ratio can, of course, be adjusted as required.

The preceding description of the present invention is merely exemplary and not intended to limit the scope thereof. The various details of the invention may vary within the scope of the inventive concept described above and differ from the particular details set forth above which have been given only as examples.

I claim:

1. Method for use in manufacturing paper having improved properties, comprising the steps of supplying a first pulp grade containing mainly long fibers into a mixing chest, supplying a second pulp grade containing mainly short fibers into said mixing chest, mixing said pulp grades in said mixing chest into a basic stock mixture containing substantially all fibers to be used for producing the particular paper, forming two different stock components from said basic stock mixture, a first of said components principally containing fibers longer than average fiber length distribution in the basic stock mixture, and a second of said components principally containing fibers shorter than the average fiber length distribution in the basic stock mixture, and also fines, feeding the first component through lateral channels of a multi-channel headbox into direct contact with a pair of wires and between the same, and feeding the second component through a middle channel of the multi-channel headbox, into the middle of a layer structure formed by the first component in contact with the pair of wires.

2. The method of claim 1, comprising the additional step of adding filler material to said second component.

3. The method of claim 2, wherein said filler material is added to said second component prior to feeding of the same into said headbox.

4. The method of claim 1, wherein said two different components are formed by fractionating said basic stock mixture of the components into at least two flow lines, a first of said flow lines principally yielding chemical pulp forming said first component, and a second of said flow lines principally yielding mechanical pulp forming said second component, both said flow lines then passing said respective components to the multi-channel headbox, whereby the chemical pulp and the mechanical pulp each substantially form a single layer in a finished paper web formed thereby.

5. The method of claim 1, wherein said two different components are formed by fractionating said basic stock mixture into two flow lines, so that a first of said flow line principally yields softwood pulp, and a second of said flow lines principally yields hardwood pulp, both said flow lines then passing the respective components to the multi-channel headbox, whereby the softwood pulp and the hardwood pulp each substantially form a single layer in a finished paper web formed thereby.

6. The method of claim 4 wherein the fractionating is accomplished by passing the basic stock mixture through at least one fractionating screen, whereby the longer and shorter fibers are separated into the respective first and second components.

7. The method of claim 5 wherein the fractionating is accomplished by passing the basic stock mixture through at least one fractionating screen.

whereby the longer and shorter fibers are separated into the respective first and second components.

8. The method of claim 7 comprising the additional step of treating said first stock components by refining so that it is fibrillated and becomes suitable to form a web surface layer for filtering of fillers and fines of the layer formed by said second component.

9. The method of claim 1, comprising the additional step of measuring into the first component, at least on additive for improving retention of fines by the second component.

10. The method of claim 1, wherein consistencies of said pulp grades at said mixing stage are on the order of about 3 to 5%.

11. The method of claim 1, comprising the additional steps of screening each said component prior to feeding into the headbox, introducing screened-out fibers into said mixing chest, and introducing wet broke from said wires into said mixing chest.

12. The method of claim 1, comprising the additional step of passing said first pulp grade through at least one refiner prior to said fixing of pulp grades.

13. The method of claim 1, wherein said second component constitutes about 60 to 70% of said basic stock mixture that is separated into said two respective components.

14. The method of claim 1, comprising the additional step of diluting said second component from a consistency of about 2 to 5%, with circulating water to a consistency of about 0.3 to 0.7%, prior to feeding the same through the middle channel of the headbox.

15. The method of claim 14, comprising the additional step of diluting said first component prior to feeding the same through the lateral channels of the headbox.

16. The method of claim 1, wherein said first component is divided and fed through said headbox to form a pair of surface layers each being about 10 to 15% of total thickness of a resulting web, whereby a web having a grammage of about 40 to 45 $g/m^2$ is formed.

17. The method of claim 1, wherein said first pulp grade is supplied from a pulp mill and said second pulp grade is supplied from a groundwood mill.

18. The method of claim 1, comprising the additional step of forming a paper web between the wires such that both surface layers of the thus-formed web are composed of well-fibrillated fibers and act as filter layers for fine material in a middle layer, whereby retention of fillers or fines in the web is increased.

19. The method of claim 18, wherein the thus-formed paper web has a grammage on the order of about 40 to 45 g/m$^2$.

20. Method of manufacturing a paper with improved properties, comprising the steps of supplying a first type of fiber stock to a mixing chest, supplying a second type of fiber stock to the mixing chest, mixing said first and second types of fiber stock to form a basic stock mixture, screening the basic stock mixture in a first fractionating device into two components, a first component essentially comprising fibers of length longer than an average fiber length in the basic stock mixture, and a second component essentially comprising fibers of length shorter than the average fiber length in the basic stock mixture, passing the thus-formed second component into a first machine chest, refining the first component, screening said thus-refined first component in a second fractionating device, passing shorter fibers removed from the first component by said second fractionating device into the first machine chest, passing the first component from said second fractionating device into a second machine chest, and passing said first and second components from said respective second and first machine chests to respective separate channels of a multi-channel headbox.

21. The method of claim 20, wherein said basic stock mixture is composed of chemical pulp and mechanical pulp.

22. The method of claim 20, comprising the additional steps of dividing said first component between said second and a third machine chest after said second fractionating device, and directing said thus-divided first component from each said chest to a respective, separate channel of said headbox.

* * * * *